US006138387A

United States Patent [19]

Fox et al.

[11] Patent Number: 6,138,387

[45] Date of Patent: Oct. 31, 2000

[54] PORTABLE ICE RESURFACING DEVICE

[76] Inventors: Paul G. Fox, 42812 Ledgeview, Novi, Mich. 48377; Louis H. Fox, 19887 E. Doyle, Grosse Pointe Woods, Mich. 48236

[21] Appl. No.: 09/111,616

[22] Filed: Jul. 7, 1998

[51] Int. Cl.[7] ..... A63C 19/10; A47L 13/26; A47L 13/30; C01C 19/22; E01H 4/00

[52] U.S. Cl. ..... 37/219; 37/196; 401/137; 401/139

[58] Field of Search ..... 401/137, 139; 37/196, 219

[56] References Cited

U.S. PATENT DOCUMENTS

| | | | |
|---|---|---|---|
| 1,656,208 | 1/1928 | Vora | 401/137 |
| 2,388,605 | 11/1945 | Eisner | 401/137 |
| 2,638,730 | 5/1953 | Davidson | 401/137 |
| 2,979,756 | 4/1961 | Wallis | 401/137 |
| 3,015,837 | 1/1962 | Teall | 401/137 |
| 3,110,055 | 11/1963 | Merrill | 401/137 |
| 3,457,015 | 7/1969 | Taber | 401/137 |
| 3,622,205 | 11/1971 | Zamboni . | |
| 3,705,746 | 12/1972 | McLeod . | |
| 3,784,311 | 1/1974 | Failing | 401/137 |
| 4,125,915 | 11/1978 | Zamboni . | |
| 4,165,192 | 8/1979 | Mellen | 401/48 |
| 4,312,142 | 1/1982 | Toepffer . | |
| 4,944,103 | 7/1990 | Rzechula . | |
| 5,007,753 | 4/1991 | England, Jr. | 404/139 |
| 5,050,530 | 9/1991 | Studebaker et al. | 118/264 |
| 5,133,139 | 7/1992 | Rzechula . | |
| 5,366,309 | 11/1994 | Springall | 401/48 |
| 5,477,583 | 12/1995 | Deloe | 15/236.01 |
| 5,701,690 | 12/1997 | Miscio . | |
| 5,771,698 | 6/1998 | Abel . | |
| 5,888,006 | 3/1999 | Ping et al. | 401/137 |

FOREIGN PATENT DOCUMENTS 06065908 3/1994 Japan .

OTHER PUBLICATIONS

Advertisement from Back yard Rinks Ltd.—Nice Ice for Ice Master Models IM 36, IM 48, IM56 and IM 66.

*Primary Examiner*—Eileen Dunn Lillis
*Assistant Examiner*—Gary S. Hartmann
*Attorney, Agent, or Firm*—Gifford, Krass, Groh, Sprinkle, Anderson & Citkowski, P.C.

[57] ABSTRACT

A portable and ice resurfacing device including an integrally constructed body having a first upper reservoir capable of storing a volume of water. A water dispensing bar extends in a generally horizontal and lengthwise fashion and is mounted within an open and lower-most location of the body proximate an ice-covered surface. A handle extends from the body and is capable of being grasped by a user to translate the body across the ice-covered surface in a drag-along fashion. The water dispensing bar is in fluid communication with the stored volume of water and is separated by a flow valve. The flow valve is actuated by a lever secured to the handle and a cable extending from the lever to the flow valve to dispense the volume of water at a specified flow rate upon the ice-covered surface. A planar shaped and flexible mat is secured to the body in a spaced apart and lengthwise extending fashion and drapes over the ice-covered surface to which the water is applied by the dispensing bar so as to evenly spread the water across the ice surface.

9 Claims, 2 Drawing Sheets

70
86
88
64
10
4
14
5
84
74
66
22
20
16
18
72'
68
40
72
28
26
5
36
24
4
30
50
32
56
82
42
44
8
80
34
78
12
90
41
76
58
38
46
48
54

66
16
14
22
20
18

10
12
42
106
44
40
88
36
50
41
89
82
60
52
96
34
90
102
104
56
38
62
46
58
48
100
54
94
98
108
92
110
112

PORTABLE ICE RESURFACING DEVICE

BACKGROUND OF THE INVENTION

1. Field of the Invention

The present invention relates generally to ice resurfacing devices and, more particularly, to a portable ice resurfacing device which is portable in nature and which includes an on-board supply of water for distribution over a specified area of ice for skating.

2. Description of the Prior Art

Ice resurfacing equipment for refreshing and reconditioning the surface area of a sheet of ice is fairly well known in the art. Such equipment is typically employed at skating events such as hockey games, competitive skating events or other entertainment shows and activities.

The most recognizable name in ice resurfacing equipment is the Zamboni resurfacing device and this is represented in part by U.S. Pat. Nos. 3,622,205 and 4,125,915, both issued to Zamboni and disclosing an ice rink resurfacing machine and a board brush apparatus for attachment to a such a machine, respectively. The operation of such self-propelled ice resurfacing machines generally includes scraping up ice shavings accumulated from skating and reapplying a smooth and continuous layer of warm water which, upon contact with the ice surface, will promptly freeze thereupon. An additional example of a "Zamboni" type self-propelled machine is further illustrated in U.S. Pat. No. 3,705,746, issued to McLeod and additional types of attachment devices for use with such self-propelled resurfacing equipment are further illustrated in U.S. Pat. No. 4,944,103, issued to Rzechula, and U.S. Pat. No. 4,312,142, issued to Toepffer.

While very suitable for large indoor ice rinks and the like, the larger self-propelled ice resurfacing devices are not practicable for use in smaller indoor ice rinks or even outdoor skating ponds which are very common in cold weather climates. The obvious reasons for the unsuitableness of the self-propelled machines are their initial cost and cost of upkeep. Accordingly, there is a market for a suitable ice resurfacing device, preferably portable and manually operable, for treating/resurfacing smaller indoor rinks and outdoor skating ponds.

The Ice Master Model IM 66 advertisement discloses a portable resurfacing machine for use primarily as a back-up to a powered Zamboni machine and potentially also with smaller indoor/outdoor ice rinks and which discloses an internally hollowed water conduit assembly including a water dispersement bar proximate a level ice surface and secured at opposite ends to a semi-circular shaped and connecting bar. A likewise internally hollowed handle extends from the semi-circular shaped connecting bar and is interconnected at an opposite end to a length of hose by means of a quick-connect and valve assembly. A resurfacing rug is attached at opposite ends alongside the water dispersement bar and facilitates even spreading of the applied water.

The concept behind the Ice Master IM 66 is to provide the water supply for resurfacing through the hose which is connected at a remote end to a water spigot. While such an arrangement may have some practicality for rinks located in indoor facilities, in which there is usually a proximately located water spigot, the Ice Master device is largely unsuitable for use with outdoor ponds in which there is no water spigot proximately located to the pond. A further obvious disadvantage is the high unlikelihood of an available outdoor spigot being functional in view of colder outdoor temperatures which are necessary for the creation of ice.

SUMMARY OF THE PRESENT INVENTION

The present invention is a portable ice resurfacing device for applying a freezable layer of warm water upon an existing ice covered surface. An integrally constructed body includes an upper reservoir capable of holding a volume of water. A water dispensing bar is provided which is internally hollowed and includes a plurality of spaced apart and downwardly facing spray apertures. The dispensing bar is secured at opposite ends to first and second downwardly extending portions at a lower-most location of the integral body.

A handle extends from the body and is capable of being grasped by a user so as to translate the body across an ice-covered surface in a drag-along fashion and so that the water dispensing bar is positioned proximate to the ice-covered surface. A flow valve is located between the water holding reservoir and the water dispensing bar and is actuated via a lever which is secured to the handle and a cable extending from the lever to the flow valve so as to dispense the volume of water at a specified flow rate upon the ice-covered surface.

An elongate bar includes first and second angled ends and is capable of being received within apertures formed at first and second locations within the body. The elongate bar further includes an outwardly spaced and centrally extending support member around which is secured a top extending edge of a planar shaped and flexible mat. The mat extends in a draping manner over a surface area of the ice surface to which the water is applied by the dispensing bar and evenly spreads the applied water across the ice surface.

A pivotable stand is secured at an upper end to the handle and is pivoted between a first secured position in which a lower end of the stand is received within and biasingly engaged by a clip portion extending from an abutting surface of the body to a second position in which the stand is pivoted outwardly from the body and the handle and body are supported in a generally upright position.

BRIEF DESCRIPTION OF THE DRAWINGS

Reference will now be made to the attached drawings, when read in combination with the following specification, wherein like reference numerals refer to like parts throughout the several views, and in which.

DETAILED DESCRIPTION OF THE PREFERRED EMBODIMENTS

Figure 1:
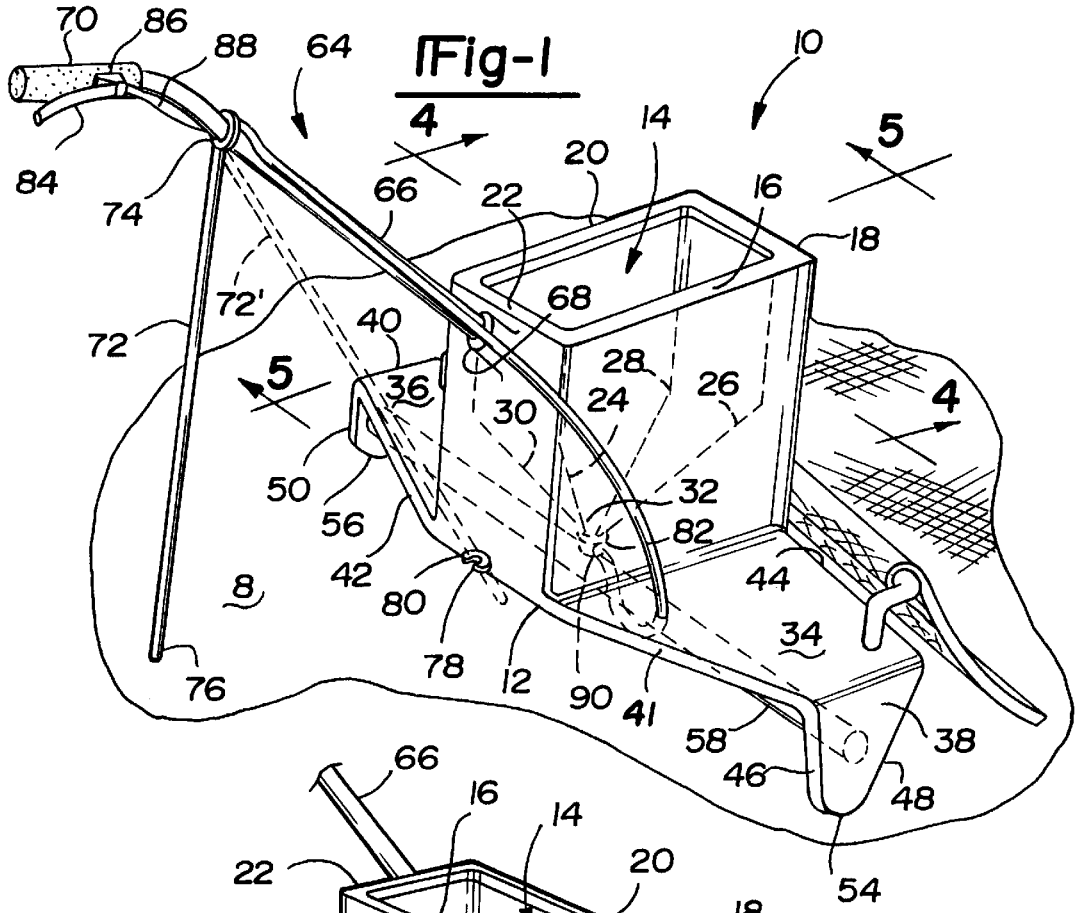
FIG. 1 is a perspective view of the portable ice resurfacing device according to the present invention.

With reference now to FIG. 1, the portable ice resurfacing device 10 is illustrated according to the present invention. The ice resurfacing device 10 includes an integrally constructed body 12 having an upper and internally hollowed portion 14 defining a water holding reservoir. Specifically, the reservoir includes a substantially rectangular shape defined by first 16, second 18, third 20 and fourth 22 interconnected walls, the inwardly facing surfaces of the interconnecting walls defining the internal reservoir. The internal reservoir narrows in a downward direction due to inwardly angled edges 24, 26, 28 and 30 (see again FIG. 1) to a flow outlet point 32.

The body 12 further includes a lower-most portion integrally formed with the upper and internally hollowed portion 14, the lower-most portion being defined by a pair of laterally and outwardly extending planar shaped bases 34 and 36 which terminate in downwardly extending portions 38 and 40. For purposes of maximization of design and material savings, the laterally and outwardly extending planar shaped bases 34 and 36 are contoured along surfaces 41 and 42, respectively, and further define a straight and level front surface 44. The downwardly extending portions 38 and 40 are further defined by inwardly converging surfaces, such as at 46 and 48 for portion 38 and 50 and 52 for portion 40, and each further includes a flattened bottom edge surface such as at 54 for portion 38 and at 56 for portion 50. The bottom edged surfaces 54 and 56 include flattened and curved bottoms to provide a more frictionless transport of the device 10 across an ice covered surface (see at 8 in FIG. 1) and as will be subsequently described.

Figure 4:
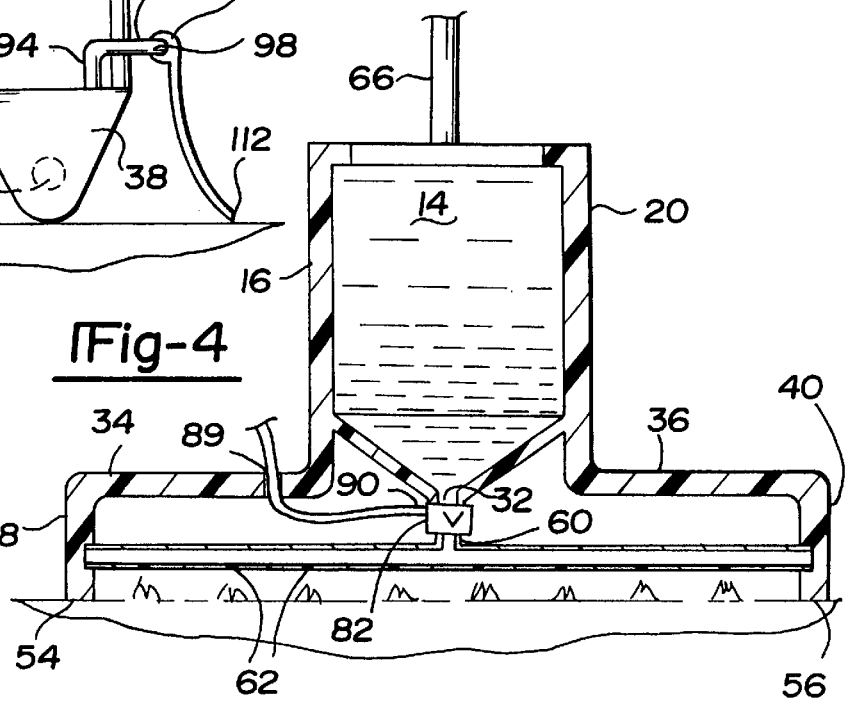
FIG. 4 is a cutaway view taken along line 4—4 of FIG. 1 and illustrating the communication of the water held within the reservoir, through the flow valve, and across the spaced spray apertures of the water dispensing bar according to the present invention.
Figure 5:
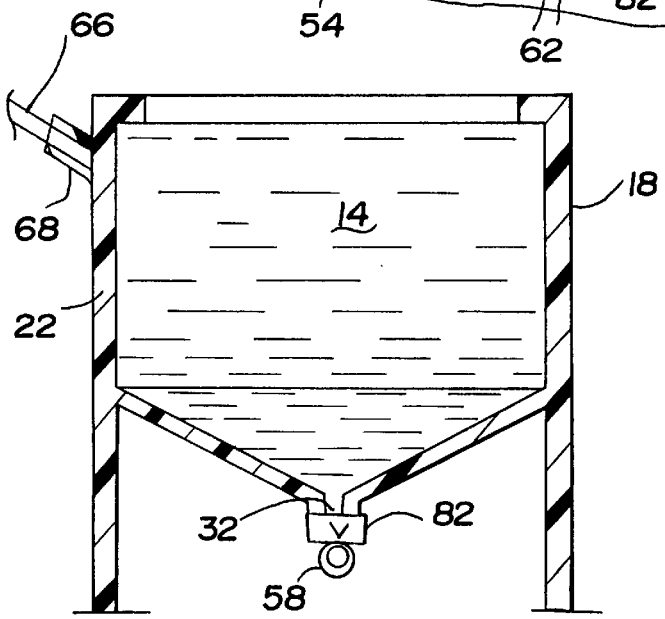
FIG. 5 is a cutaway view taken along line 5—5 of FIG. 1 and illustrating a side profile of the internal water holding reservoir, flow valve and water dispensing bar as illustrated in FIG. 4 and according to the present invention.

Referring again to FIGS. 1 and 2, and also to FIGS. 4 and 5, fluid applicating means are provided for conveying the water held within the reservoir 14 and upon the ice-covered surface 8. The fluid applicating means is provided according to the preferred embodiment as an elongate and water dispensing bar 58 which is secured at opposite ends to the downwardly extending portions 38 and 40 and so that it is arrayed in substantially horizontally extending fashion in a lower-most and bottom facing location proximate the ice covered surface 8.

The water dispensing bar 58 is fluidly communicated with the reservoir 14 by means of an inlet 60 and the bar 58 is further internally hollowed (as clearly illustrated in FIG. 5) so as to convey the water in a gravity draining manner from the reservoir 14 and in an internally channeled manner so as to disperse the water through a plurality of spaced apart apertures 62 formed along bar 58 and facing the ice covered surface 8. The apertures 62 may be provided as single holes of predetermined diameter or, alternatively, may be formed as distinct pluralities of smaller holes so as to issue the water stream in a more spray-like manner.

A handle assembly 64 (FIG. 1) is provided an includes an elongate handle member 66 which is secured at one end within a receptor 68 extending from a rearward location of the integrally shaped body 12. The elongate handle member 66 terminates at an opposite end in an angularly configured gripping portion 70 which is suitable for being grasped by a user so as to translate the device 10 across the ice covered surface 8 and in a manner as will be subsequently described in more detail.

An elongate and pivotally secured stand member is provided at 72 and is pivotally secured at its upper end 74 to a location of the elongate handle member 66 proximate the gripping portion 70. The stand member 72 is pivotable from a first secured position in which a lower end 76 of the stand 72 is received within a generally circular shaped clip member 78 extending from a rear abutting surface of the integral body 12 to a second position, in which the stand member 72 is illustrated in solid, in which it supports the body 12 and handle assembly 64 in an upstanding position. As is illustrated in FIG. 1, the stand member 72 is shown in phantom, at 72' and is biasingly engaged within an opening 80 in the clip member 78 so as to lay substantially flush against the surface of the integral body 12. The stand member 72 is rearwardly urged by the user to disengage from within the clip member 78 and to pivot to the employed position as shown in FIG. 1.

Referring again to FIGS. 1, 2, 4 and 5, a flow valve 82 is located along the flow output point 32 between the water filled reservoir 14 and the horizontally arrayed and water dispensing bar 58. As is customarily known in the art, the flow valve 82 is actuable between on and off positions as well as being able to adjust a degree of flow of water therethrough for issuance through the dispensing bar 58.

Actuation of the flow valve 82 is achieved by a lever 84 (see FIG. 1) mounted to the gripping portion 70 at 86. A cable 88 is secured at one end to the lever 84 and extends generally along the elongate handle 66, passes through an aperture 89 formed in the planar shaped base 34 and secures at the other end at 90 to the flow valve 82. The lever 84 is pivotably depressed inwardly to in turn actuate the cable and to open the flow valve 82 (such as is known by conventional type valves which rotate relative to the surrounding channel) and which is created at the flow output point 32 to open and close according to the desired degree.

An elongate bar 92 includes a first inwardly angled end 94 and a second inwardly angled end 96 and extending between the angled ends 94 and 96 is an elongated and central member 98. The central member 98 is outwardly spaced from the angled ends 94 and 96, such as is designated at 100 and 102, so as to be suitably dimensioned from the level front surface 44 when the inwardly angled ends 94 and 96 are insertably engaged through appropriately formed apertures 104 and 106 formed in the flattened bottoms 54 and 56.

Figure 2:
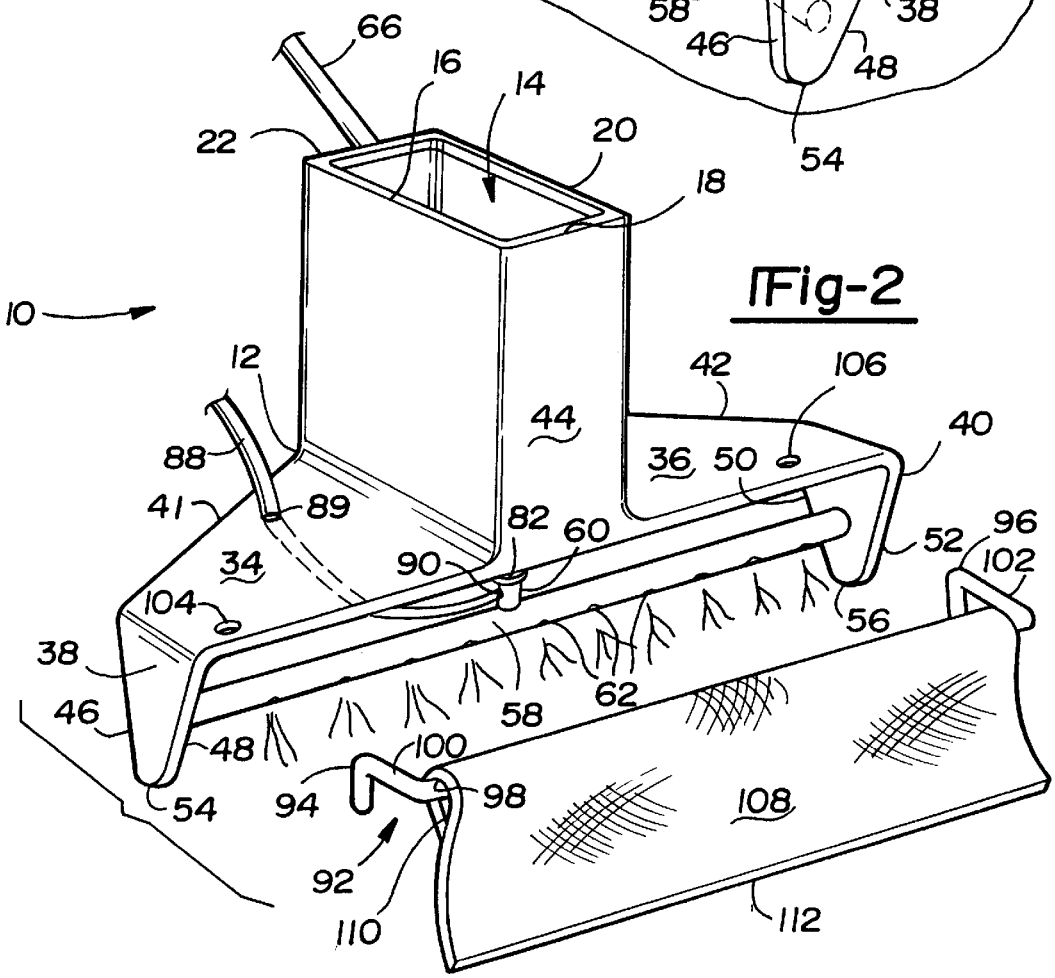
FIG. 2 is a further perspective view of the ice resurfacing device according to FIG. 1 and further illustrating such features as the water dispensing bar and water spreading mat according to the present invention.
Figure 3:
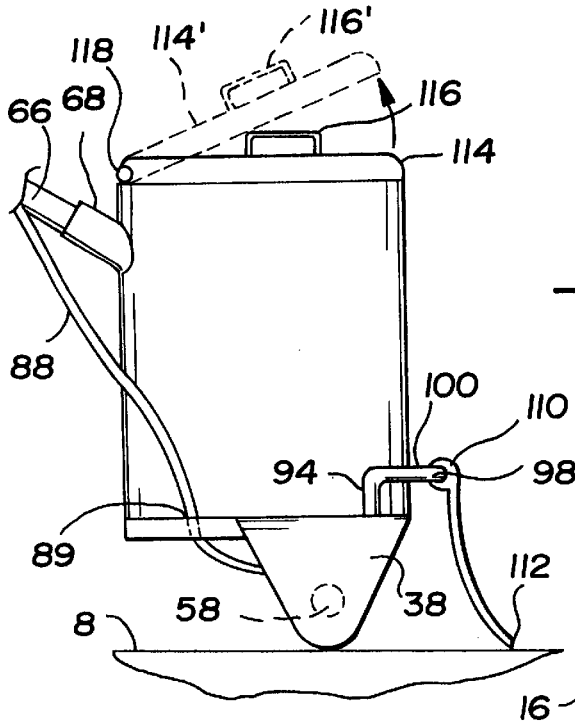
FIG. 3 is a sectional view in side profile of the integral body construction of the ice resurfacing device according to the present invention and further showing an optional pivotally attachable lid atop the water holding reservoir and the flow valve cable which extends from the handle.

Referring to FIGS. 1 and 2, and also to FIG. 3, a planar shaped and flexible mat 108 is provided, a top edge 110 of which is looped around the central member 98 of the elongate bar 92 and so that a lower trailing edge 112 of the mat is draped over the ice covered surface 8. The flexible mat 108 is constructed of any suitable material such as a cloth or even a rubberized material or like composition and provides the function of evenly spreading the water applied through the dispensing bar 58 across the ice covered surface 8 prior to it freezing in place. The mat 108 also provides the function of assisting in leveling or smoothing over any other such imperfections in the ice covered surface which result from skate marks and the like and for which it is desirable to obtain a level skating surface.

Referring again to FIG. 3, a further optional variant is disclosed in which a lid 114 is secured atop the open reservoir 14 and includes a handle 116 and a rear edge pivotal/hinged connection 118. The provision of a lid 114 is useful in some situations where there is a concern of overflow or spillage of the water during transport from a filling point to the point of delivery. The lid 114 may also be useful for blocking out wind chill (particularly in very cold outdoor applications) and for preventing the water from freezing within the reservoir 14 before the user has an opportunity to apply it over the ice covered surface 8.

In use, the user fills the internal reservoir 14 of the device 10 with a specified volume of water for adding a resurfacing/ covering layer atop a pre-existing ice covered area. During filling, the pivotable stand member 76 may be outwardly pivotably engaged to maintain the device 10 in an upright position.

Once filled, the stand member 76 is retracted and engaged within the clip 78 and the device is then transported, if not already positioned, to the location at which application of the resurfacing layer is desired. Upon commencement of resurfacing, the user depresses inwardly the lever 84, causing the cable 88 to open the flow valve 82 and the water contained within the reservoir 14 to pass into the hollowed interior channel of the dispensing bar 58 and out through the various applicating apertures 62. As is also best shown in the cutaway of FIG. 4, the dispensing bar 58 is located in close upwardly spaced proximity to the ice covered surface for optimal application of the resurfacing layer and, during dragging of the unit, the dragging end 112 of the flexible mat 108 evenly spreads the applied water across the ice covered surface.

Having described my invention, additional embodiments will become apparent to those skilled in the art to which it pertains without deviating from the scope of the appended claims. Specifically, alternate variants to the integral body design may be employed, such as fabricating the body from wooden or artificial members and providing the water reservoir as a bucket, plastic jerry can or jug which is mounted atop the framework and is capable of distributing the water in a gravity feed fashion through an appropriately positioned flow valve underneath and interconnected to a fluid applicating means of some type, including a dispensing or other suitable spray applicator. Furthermore, it is envisioned that such a jerry can or bucket may be detachable from the device and refilled at a remote supply source prior to reattachment.

What is claimed is:

1. A portable ice resurfacing device, comprising:

a body capable of holding a volume of a fluid, said body further including an integrally formed and upper reservoir capable of holding said volume of fluid;

a fluid applicating means extending from a lower-most location of said body and in communication with said held volume of fluid, said fluid applicating means further comprising a water dispensing bar extending in a generally horizontal and lengthwise fashion across said lower-most location of said body and securing at opposite ends to first and second downwardly extending portions, said water dispensing bar further being internally hollowed and including a plurality of spaced apart and downwardly arrayed spray apertures;

a handle extending from said body and capable of being grasped by a user so as to translate said body across an ice-covered surface and so that said fluid applicating means is positioned proximate to the ice-covered surface; and a flow valve located between said reservoir and said water dispensing bar, said valve being actuated by a lever secured to said handle and a cable extending from said lever to said flow valve to dispense said volume of fluid in a gravity feed fashion and at a specified flow rate upon the ice-covered surface.

2. The portable ice resurfacing device according to claim 1, further comprising a planar shaped and flexible mat and means for securing said mat in a lengthwise extending fashion to a rearward location of said body and in proximity to said fluid applicating means, said mat evenly spreading said applied water across the ice surface.

3. The portable ice resurfacing device according to claim 2, said mat securing means further comprising an elongate bar including first and second inwardly angled ends capable of being received within apertures formed at first and second locations within said body, said bar further including an outwardly spaced and central support around which is secured an upper end of said mat.

4. The portable ice resurfacing device according to claim 1, further comprising a pivotable stand secured at an upper end thereof to said handle, said stand being pivotable from a first secured position in which a lower end thereof is received within a clip extending from an abutting surface of said body to a second position in which said stand is pivoted outwardly from said body and said handle and body are supported in a generally upright position.

5. A portable ice resurfacing device, comprising:

an integrally constructed body including a reservoir capable of holding a volume of water, an upper and internally hollowed portion of said body defining said reservoir, a lid functioning to block out wind chill and for preventing water from freezing within said reservoir and for prevention of splashing during transportation and application, said lid being pivotally secured atop said reservoir;

a fluid applicating means extending in a generally horizontal and lengthwise fashion and mounted within an open and lower-most location of said body beneath said water holding reservoir, said fluid applicating means being in fluidic communication with said water reservoir;

a handle extending from said body and capable of being grasped by a user so as to translate said body across an ice-covered surface and so that said fluid applicating means is positioned proximate to the ice-covered surface;

a flow valve located between said water holding reservoir and said water dispensing bar, said valve being actuated by a lever secured to said handle and a cable extending from said lever to said flow valve to dispense said volume of fluid at a specified flow rate upon the ice-covered surface; and a planar shaped and flexible mat secured in a lengthwise extending fashion to a rearward location of said body and in proximity to said water dispensing bar, said mat evenly spreading the applied fluid across the ice surface.

6. The portable ice resurfacing device according to claim 5, said fluid applicating means further comprising a water dispensing bar extending in a generally horizontal and lengthwise fashion across said lower-most location of said body and securing at opposite ends to first and second downwardly extending portions, said water dispensing bar further being internally hollowed and including a plurality of spaced apart and downwardly arrayed spray apertures.

7. The portable ice resurfacing device according to claim 5, further comprising a pivotable stand secured at an upper end thereof to said handle, said stand being pivotable from a first secured position in which a lower end thereof is received within a clip extending from an abutting surface of said body to a second position in which said stand is pivoted outwardly from said body and said handle and body are supported in a generally upright position.

8. A portable and drag-along ice resurfacing device, comprising:

an integrally constructed body including an upper reservoir capable of holding a volume of water;

a water dispensing bar extending in a generally horizontal and lengthwise fashion across a lower-most location of said body in fluid communication with said water holding reservoir and securing at opposite ends to first and second downwardly extending portions, said water dispensing bar further being internally hollowed and including a plurality of spaced apart and downwardly arrayed spray apertures;

a handle extending from said body and capable of being grasped by a user so as to translate said body across an ice-covered surface in a drag-along fashion and so that said fluid applicating means is positioned in a proximate and upwardly spaced manner relative to the ice-covered surface;

a flow valve located between said water holding reservoir and said water dispensing bar, said valve being actuated by a lever secured to said handle and a cable extending from said lever to said flow valve to dispense said volume of fluid at a specified flow rate upon the ice-covered surface; and an elongate bar including first and second angled ends capable of being received within apertures formed at first and second locations within said body, said bar further including an outwardly spaced and central support around which is secured a top extending edge of a planar shaped and flexible mat, said mat extending draping over a surface area of the ice surface to which the water is applied by said dispensing bar and evenly spreading said applied water across the ice surface; and a pivotable stand secured at an upper end thereof to said handle, said stand being pivotable from a first secured position in which a lower end thereof is received within a clip extending from an abutting surface of said body to a second position in which said stand is pivoted outwardly from said body and said handle and body are supported in a generally upright position.

9. A portable ice resurfacing device, comprising:

a body capable of holding a volume of a fluid, said body further including an integrally formed and upper reservoir capable of holding said volume of fluid, a lid pivotally secured to said reservoir and capable of being upwardly pivoted to reveal said volume of held fluid;

a fluid applicating means extending from a lower-most location of said body and in communication with said held volume of fluid;

a handle extending from said body and capable of being grasped by a user so as to translate said body across an ice-covered surface and so that said fluid applicating means is positioned proximate to the ice-covered surface; and said fluid applicating means capable of being activated to dispense said volume of fluid in a gravity feed fashion and at a specified flow rate upon the ice-covered surface.

* * * * *